US005320557A

United States Patent [19]

Gizienski

[11] Patent Number: 5,320,557

[45] Date of Patent: Jun. 14, 1994

[54] STRAIN RELIEF FOR ELECTRICAL CORDSETS

[75] Inventor: John J. Gizienski, Coventry, R.I.

[73] Assignee: General Electric Company, Schenectady, N.Y.

[21] Appl. No.: 81,874

[22] Filed: Jun. 25, 1993

[51] Int. Cl.[5] ..... H01R 13/56

[52] U.S. Cl. ..... 439/445; 439/460

[58] Field of Search ..... 439/445–447, 439/457, 459, 460

[56] References Cited

U.S. PATENT DOCUMENTS 3,800,068 3/1974 Torgeason ..... 439/447 X 4,178,057 12/1979 McCormick ..... 439/459

*Primary Examiner*—Eugene F. Desmond

*Attorney, Agent, or Firm*—Edward M. Corcoran; Stanley C. Corwin

[57] ABSTRACT

To protect against flexure-induced failure of the conductors of an electrical cord terminated by an electrical connector, a strain relief in the form of an exterior collar is integrally formed with the connector in aligned relation with an exit opening in the connector body from which the cord emerges. The collar surrounds the exiting portion of the cord and is configured to provide longitudinally offset fulcrums for establishing longitudinally displaced flex points in the cord conductors depending upon the direction of flexure of the cord beyond the connector.

9 Claims, 2 Drawing Sheets

STRAIN RELIEF FOR ELECTRICAL CORDSETS

BACKGROUND OF THE INVENTION

1. Field of the Invention

The present invention relates to electrical wiring devices and particularly to a strain relief for electrical cordsets.

2. Description of the Related Art

A particular problem that has historically plagued electrical cordsets is conductor breakage at a point adjacent the exit of the electrical cord from connectors electrically terminating the cordset. Particularly in the case of light duty cordsets where the conductor size is 18 gauge or smaller, the electrical cord is extremely flexible. During normal use, the cord is typically subjected to flexure-induced stresses concentrated at a point where the cord exits the electric connector terminating the cordset. At this point of connector exit, the cord is no longer constrained and thus is free to bend on an extremely small radius. During normal use over years of service, the cord is repeatedly flexed in opposite directions about opposed fulcrums where the connector engages the cord at the exit opening in the connector body from which the cord emerges. Consequently, the high stress in the copper conductors of the cord are concentrated at this exit point where flexure or bending begins. In time, the copper conductors can be fatigued to the point of breakage. The resulting loss of electrical continuity renders the cordset useless.

In recognition of the problem, manufacturers have resorted to using semi-rigid polyvinyl chloride molding materials for the connector so that a relatively flexible sleeve can be included to surround an extended portion of the cord exiting the connector. This strain relieving sleeve enforces a larger bend radius on the cord as it undergoes flexure. When the bend radius is increased, less stress is concentrated in the cord conductors at the initial flex point where the cord emerges from the sleeve. Thus, work hardening and fatigue of the cord conductors are reduced. However, the use of semi-rigid vinyl connectors with strain relieving sleeves has the disadvantage of added material and manufacturing costs and poor elevated temperature performance. Rigid plastic molded materials are preferable because of lower manufacturing and material costs and superior elevated temperature stability.

Underwriter Laboratories (UL) and the Canadian Standards Association (CSA) have devised a safety/performance test that manufactured cordsets must pass in order to be listed. This test requires that a cordset undergo a 2500 cycle flex test which involves suspending a 4 oz. weight from the cord, while the connector is rotated through a 180° sweep, 2500 times. The cordset passes, if at the end of this extremely rigorous test, the cord conductors retain continuity.

SUMMARY OF THE INVENTION

It is accordingly an objective of the present invention to provide a strain relief for an electrical cord that is effective in reducing flexure-induced failure of the cord conductors at the point where the cord exits the connector electrically terminating the cord. A further objective is to provide a strain relief effective against flexure-induced failure of electrical cord conductors that is efficient in construction and inexpensive to manufacturer using substantially rigid plastic molding materials for the connectors electrically terminating the electrical cord.

To these ends, the present invention provides a connector for electrically terminating an electrical cord that includes a body having an exit opening from which the electrical cord terminated by the connector emerges. An exterior strain relief, carried by the connector body in aligned relation with the exit opening, is structured to provide a pair of offset fulcrums for engaging the terminal portion of the cord at longitudinally displaced flex points depending upon the direction of flexure of the cord beyond the connector.

In a preferred embodiment of the invention, the connector is formed of a rigid plastic material and the strain relief is in the form of an exterior collar joined at one end to the connector body in aligned relation with the exit opening, with the free end of the collar configured to establish longitudinally displaced flex points on the terminal portion of the cord emerging from the exit opening.

Additional features and advantages of the invention will be set forth in the description which follows, and in part will be apparent from the description, more may be learned by practice of the invention. The objectives and other advantages of the invention will be realized and obtained by the electrical cord strain relief particularly pointed out in the written description and claims, as well as in the appended drawings.

It is to be understood that both the foregoing general description and the following detailed description are exemplary and explanatory and are intended to provide further explanation of the invention as claimed.

The accompanying drawings which are included to provide a fuller understanding of the invention and are incorporated in and constitute a part of this specification, illustrate an embodiment of the invention and together with the description serve to explain the principles of the invention.

DETAILED DESCRIPTION

Figure 1:
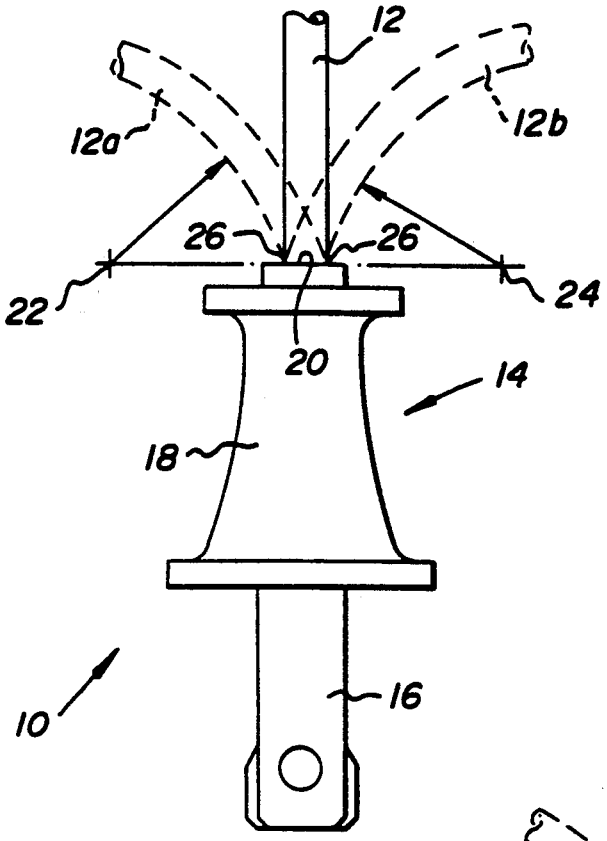
FIG. 1 PRIOR ART
FIG. 1 is a side elevational view of the terminal portion of a prior art electrical cordset terminated by a plug connector.

In the prior art electrical cordset generally indicated at 10 in FIG. 1, an electrical cord 12 is terminated by a plug connector, generally indicated at 14 and equipped with blades 16 for electrical plug-in engagement with a receptacle, such as a wall outlet, not shown. The plug connector comprises a body 18 formed of a rigid plastic material molded about the terminal portion of the cord, with the bared ends (not shown) of the cord conductors electrically connected to blades 16. The cord emerges from the connector body through an exit opening 20 beyond which it is free to flex in opposite directions as illustrated in phantom line at 12*a* and 12*b*. When the cord is flexed to the left as illustrated at 12*a*, it bends generally along an arc having a radius center 22. With flexure in the opposite direction, the cord generally bends along an arc having a radius center 24. It is seen that these radius centers are laterally aligned with the points of initial cord bending or flexure being located at opposed edges of the exit opening 20 in the connector body. Thus, opposed edges of the exit opening act as laterally aligned fulcrums 26 which create a concentrated stress region in the copper conductors of the cord at the exit opening. With repeated flexure in cord directions 12*a* and 12*b*, the cord conductors experience work hardening and ultimately fatigue failure with consequent loss of electrical continuity. Experience has shown that cordset 10 has difficulty passing the 2500 cycle flex test administered by UL.

Figure 2:
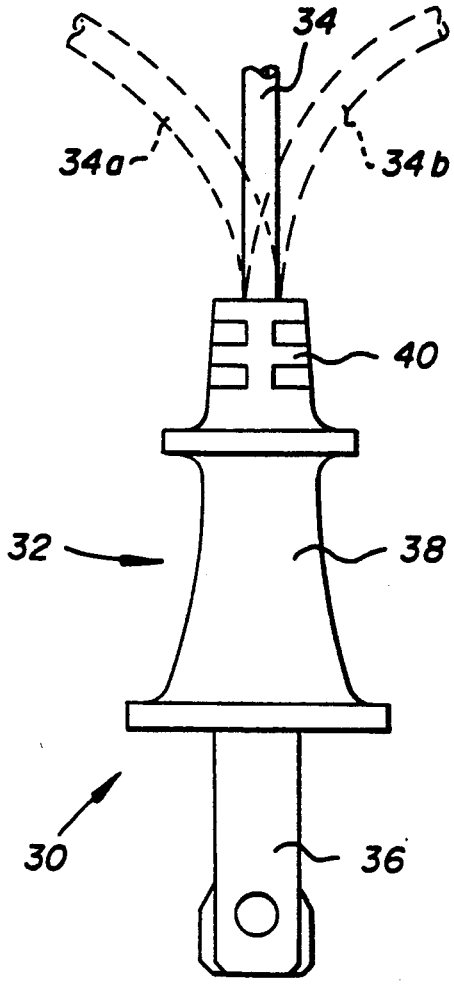
FIG. 2 PRIOR ART
FIG. 2 is a side elevational view of the terminal portion of a prior art electrical cordset terminated by a plug comprised of a semi-rigid molded plastic material with an integral strain relieving sleeve.

FIG. 2 illustrates a cordset 30, wherein a plug connector 32 of semi-rigid plastic material, such as polyvinyl chloride, is molded about the terminal portion of a cord 34 whose copper conductors are electrically connected to blades 36. Molded with the connector body 38 is a relatively flexible sleeve 40 surrounding the exiting portion of the cord. This sleeve provides strain relief for the cord by imposing a larger bend radius than is achieved in the cordset 10 of FIG. 1 when the cord is flexed in opposite direction, as illustrated in phantom at 34*a* and 34*b*. As a consequence less stress is concentrated on the cord conductors at the point of exit from the relatively soft and flexible material of sleeve 40. Thus, cordset 30 typically passes the 2500 cycle flex test. However, as noted above, a molded polyvinyl chloride connector 32 is more extensive in terms of material and manufacturing costs and is not as stable at elevated temperatures as connector 14 of FIG. 1, formed of the preferred rigid molded plastic material.

Figure 3:
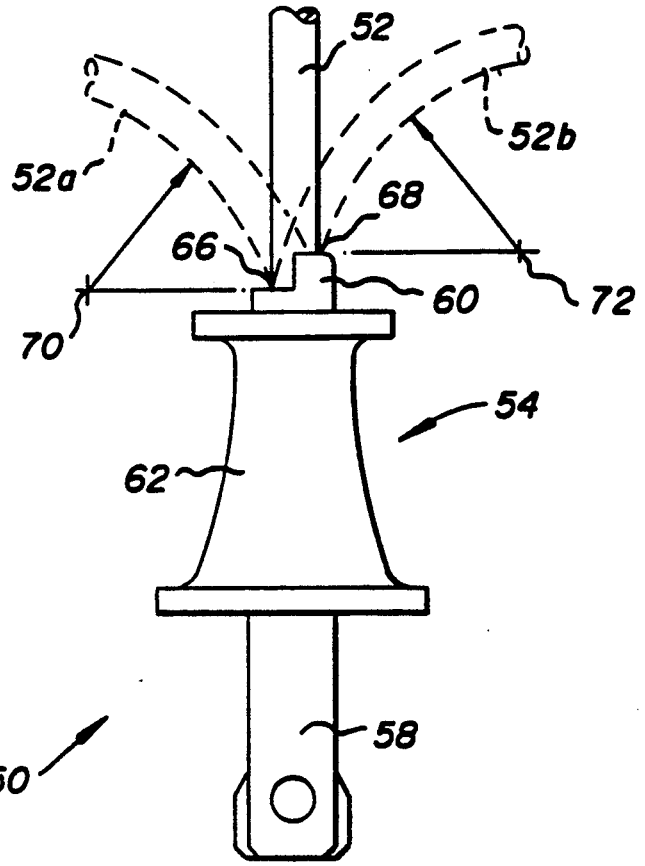
FIGS. 3 and 4 are side elevational views of the terminal portion of an electrical cordset terminated by a plug connector equipped with a strain relief constructed in accordance with the present invention.
Figure 4:
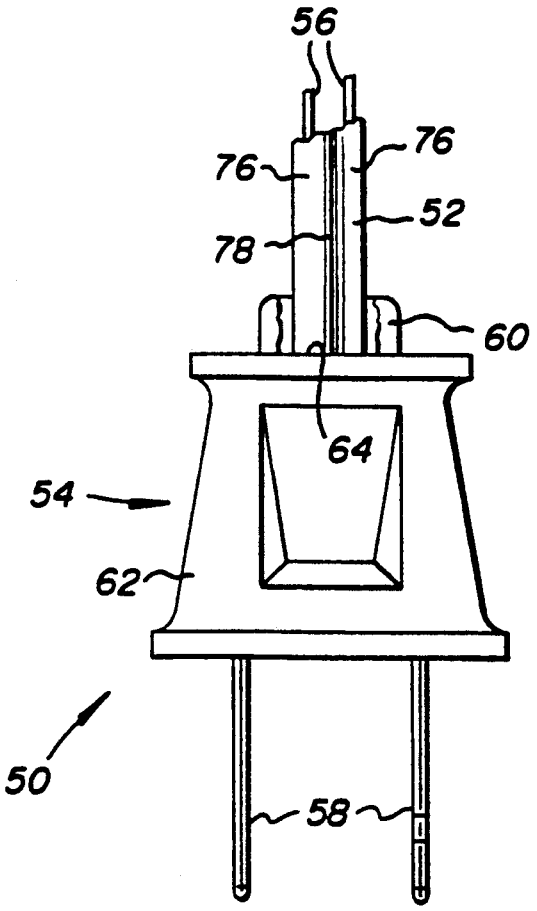

FIGS. 3 and 4 illustrate a cordset, generally indicated at 50, which is constructed in accordance with the present invention to dramatically reduce flexure-induced conductor failure at the exit point of a cord 52 from an electrically terminating connector, generally indicated at 54. The connector, of a substantially rigid plastic material, is molded about the terminal portion of the cord with the cord conductors 52 electrically connected to blades 58.

In accordance with the present invention, a strain relief in the form of an exterior collar 60, is integrally molded with connector body 62 in aligned relation with an exit opening 64 through which cord 52 emerges from the connector. The free end of the collar is configured to provide longitudinally offset end surfaces effective in establishing correspondingly offset fulcrums 66 and 68. Thus, when cord 52 is flexed to the left as illustrated in phantom at 52*a*, it bends generally along an arc having a radius center 70 whose location is generally determined by the engagement of the cord with fulcrum 66, which defines the initial flex point at which the cord bending arc begins. However when the cord is flexed to the right, as illustrated in phantom at 52*b*, it bends generally along an arc having a radius center 72 whose location is generally determined by the engagement of the cord with fulcrum 68 at the flex point where the cord bending arc begins. It is seen that radius centers 70 and 72 are longitudinally offset in the same proportion as fulcrums 66 and 68. By virtue of the relative displacement of these fulcrums, flexure-induced stress concentrations in the cord conductors 56 are likewise displaced. That is, when the cord is flexed to the left, the highest stress region in the cord conductors is located adjacent fulcrum 66. However, when the cord is flexed to the right, the highest stress region in the cord conductors is located adjacent fulcrum 68. Thus the high stress region locations in the cord conductors are different depending upon which direction the cord is flexed. Assuming that, over time, the number of cord flexures in each direction even out, the stress relief of the present invention should at least double the cord conductor life. In fact when samples of cordset 50 having a 100 mil fulcrum offset were subjected to the UL flex test, conductor failures did not occur until the cords were flexed through 180° sweeps exceeding 8000 cycles.

As the orthogonally related side views of FIGS. 3 and 4 illustrate, cord 52 is of an essentially flat cross-sectional configuration with conductors 56 encased in essentially separate molded insulating sleeves 76 joined by a continuous web 78. Thus the conductors are retained in continuous side-by-side relation defining a plane. Consequently the cord is only highly flexible in opposite directions normal to this plane as illustrated in FIG. 3. The cord is however quite rigid against flexure in directions within this plane, and thus flexure of the cord to the left and right in the orientation of FIG. 4 results in a large bend radius and therefore produces negligible stress concentrations in the cord conductors.

While collar 60 is illustrated as having a stepped free end configuration, it will be appreciated that the requisite longitudinal offset of fulcrums 66 and 68 can be achieved with curved transitions between the offset surface portions of the collar free end. Also the desired strain relief may be realized with a semicircular collar in the form of a trough, wherein fulcrum 66 would be located at the edge of exit opening 64. While the disclosure has been directed to implementation of the invention in a cordset, it will be appreciated that the disclosed strain relief may be provided on replacement connectors (plugs and receptacles) that homeowners can purchase separately to terminate electrical cords.

It will be appreciated to those skilled in the art that various modifications and variations can be made in the strain relief of the present invention without departing from the spirit or scope of the invention. Thus it is intended that the present invention cover the modifications and variations of this invention provided they come within the scope of the appended claims and their equivalents.

What is claimed is:

1. An electrical cordset comprising:

an electrical cord;

an electrical connector including a body having an exit opening through which a terminal portion of the cord emerges, and an exterior collar affixed at one end to the body in aligned relation with the exit opening and at least partially surrounding the terminal portion of the cord, the collar having a free end configured to establish relatively displaced flex points on the cord depending upon the direction of flexure of the cord beyond the electrical connector.

2. The electrical cordset defined in claim 1, wherein the collar is configured to provide first and second offset fulcrums, the first fulcrum engaging the cord at a first flex point as the cord is flexed in generally a first direction, and the second fulcrum engaging the cord at a second flex point as the cord is flexed in generally a second direction essentially opposite to the first direction.

3. The electrical cordset defined in claim 2, wherein the first and second fulcrums are longitudinally offset by at least approximately 100 mils.

4. The cordset as defined in claim 2, wherein the cord is of a generally flat configuration having a pair of side-by-side conductors encased in molded insulation, the first and second directions being substantially normal to a plane defined by the side-by-side conductors.

5. The cordset defined in claim 2, wherein the collar is integrally formed with the connector body.

6. The cordset defined in claim 5, wherein the collar and connector body are formed of a molded, substantially rigid plastic material.

7. An electrical connector for terminating an electrical cord, the electrical connector comprising:

a body having an exit opening; and an exterior strain relief carried by the body in aligned relation with the exit opening, the strain relief structured to provide first and second offset fulcrums for engaging an electrical cord emerging from the exit opening at longitudinally displaced flex points depending upon the direction of flexure of the cord beyond the connector.

8. The electrical connector device defined in claim 7, wherein the connector body and the strain relief are integrally formed of a molded, substantially rigid plastic material.

9. The electrical connector defined in claim 5, wherein the first and second fulcrums are longitudinally offset by at least approximately 100 mils.

* * * * *